US008550025B2

(12) United States Patent
Machida

(10) Patent No.: US 8,550,025 B2
(45) Date of Patent: Oct. 8, 2013

(54) ROWING BOAT FOOTREST ASSEMBLY

(75) Inventor: Muneyasu Machida, Osaka (JP)

(73) Assignee: Shimano Inc., Osaka (JP)

( * ) Notice: Subject to any disclaimer, the term of this patent is extended or adjusted under 35 U.S.C. 154(b) by 130 days.

(21) Appl. No.: 13/049,016

(22) Filed: Mar. 16, 2011

(65) Prior Publication Data

US 2012/0234226 A1 Sep. 20, 2012

(51) Int. Cl.
*B63B 17/00* (2006.01)

(52) U.S. Cl.
USPC ..... 114/363

(58) Field of Classification Search
USPC ..... 114/363; 441/70
See application file for complete search history.

(56) References Cited

U.S. PATENT DOCUMENTS 231,017 A 8/1880 Davis
5,367,976 A * 11/1994 Van Schaik ..... 114/347
5,810,370 A * 9/1998 Covert et al. ..... 280/14.24
2009/0205556 A1 8/2009 Kawahara et al.
2009/0241827 A1* 10/2009 Matsueda et al. ..... 114/363
2010/0018450 A1 1/2010 Matsueda et al.
2011/0315065 A1 12/2011 Sakaue
2011/0315066 A1 12/2011 Matsueda

OTHER PUBLICATIONS

U.S. Appl. No. 13/049,016, filed Mar. 16, 2011, Machida

* cited by examiner

*Primary Examiner* — Stephen Avila
(74) *Attorney, Agent, or Firm* — Global IP Counselors

(57) ABSTRACT

A rowing boat footrest assembly is provided with a base, an attachment structure, a limit structure and an adjustment structure. The attachment structure is coupled to the base, and configured and arranged to support a cleat. The limit structure limits a movement of the cleat to a first movement range in a transverse direction with respect to a longitudinal boat direction. The adjustment structure is provided at a location such that the adjustment structure adjusts the first movement range to a second movement range that is smaller than the first movement range.

19 Claims, 14 Drawing Sheets

ROWING BOAT FOOTREST ASSEMBLY

BACKGROUND

1. Field of the Invention

This invention generally relates to a rowing boat footrest assembly. More specifically, the present invention relates to a rowing boat footrest assembly which includes a cleat attachment structure and an adjustment structure for adjusting lateral movement of a rower's shoe with respect to the cleat attachment structure.

2. Background Information

Traditionally, the footrest in a rowing boat is an angled surface upon which a rower can brace his or her feet. Recently, footrests have been provided with simple shoe retaining straps or mechanisms that hold a rower's shoe against the surface of the footrest.

SUMMARY

One aspect is to provide a rowing boat footrest assembly that includes an adjustment structure for adjusting lateral movement of a rower's shoe with respect to a cleat attachment structure of the rowing boat footrest assembly.

In view of the state of the known technology, a rowing boat footrest assembly is proposed that basically comprises a base, an attachment structure, a limit structure and an adjustment structure. The attachment structure is coupled to the base, and configured and arranged to support a cleat. The limit structure limits a movement of the cleat to a first movement range in a transverse direction with respect to a longitudinal boat direction. The adjustment structure is provided at a location such that the adjustment structure adjusts the first movement range to a second movement range that is smaller than the first movement range.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
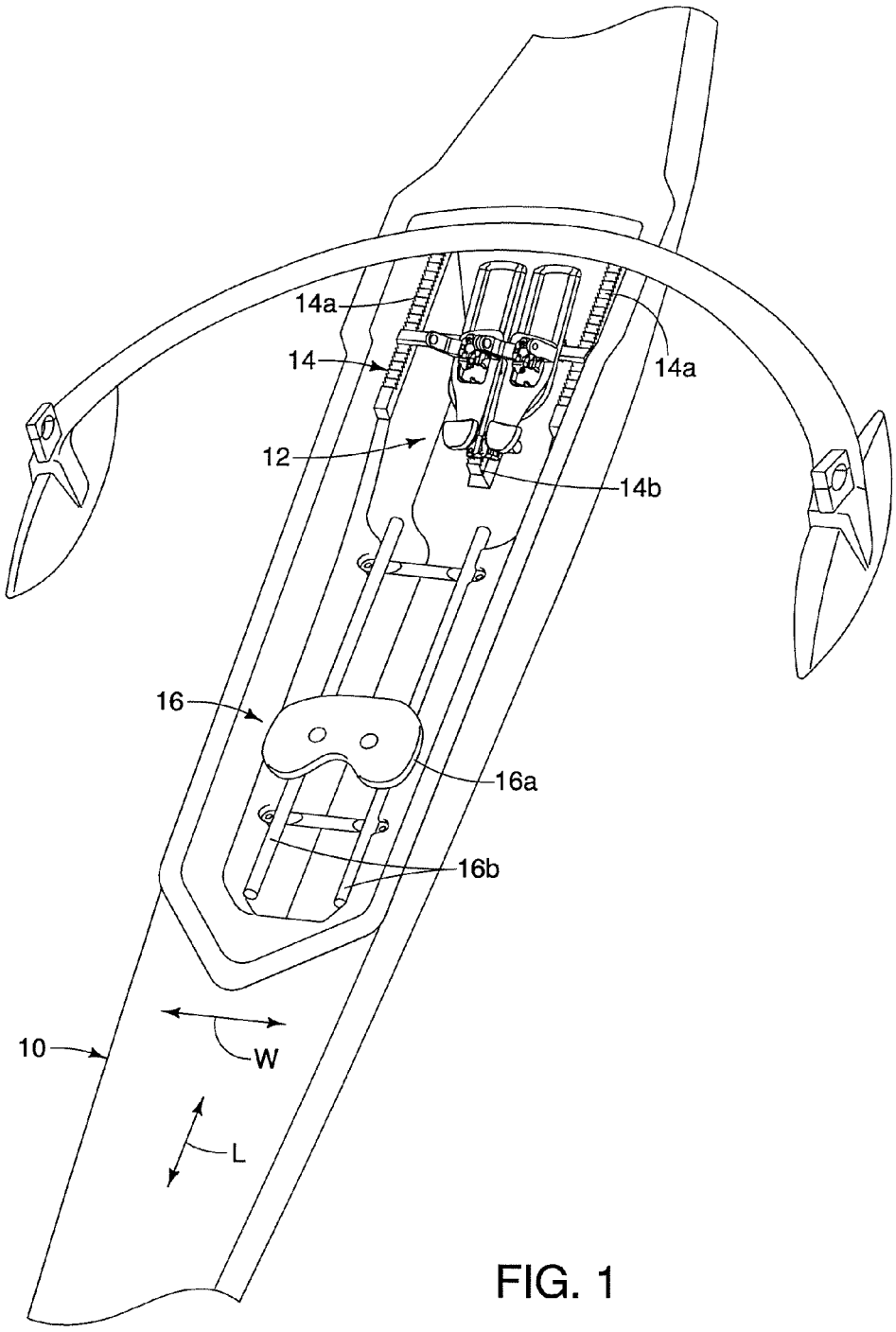
FIG. 1 is a partial perspective view of a rowing boat with a rowing boat footrest assembly in accordance with a first embodiment.

Referring initially to FIG. 1, a rowing boat 10 is illustrated that is equipped with a rowing boat footrest assembly 12 in accordance with a first embodiment. The rowing boat 10 has a longitudinal or lengthwise boat direction L and a lateral or widthwise boat direction W that is of course perpendicular to the longitudinal or lengthwise boat direction L. In this illustrated embodiment, the rowing boat 10 includes a stationary footrest mounting structure 14 for supporting the rowing boat footrest assembly 12, and a sculling seat structure 16. While the rowing boat footrest assembly 12 is installed in a single person rowing boat in this illustrated embodiment, typically the boat footrest assembly 12 is installed in boats for two or more rowers such that one of the rowers can steer the boat with the boat footrest assembly 12. Thus, the boat footrest assembly 12 can be mounted in any type of rowing boat as needed and/or desired. Moreover, while the rowing boat 10 is illustrated as a single person sculling boat, the rowing boat footrest assembly 12 can be installed in other types of rowing boats such as a sweep-oar rowing boat where each rower has one oar held by both hand. The conventional oars of the rowing boat 10 are omitted for the sake of brevity and to provide greater clarity in the drawings. Likewise, other conventional parts (e.g., a sliding seat) of the rowing boat 10 are omitted for the sake of brevity.

The stationary footrest mounting structure 14 can be a relatively conventional structure, as shown, that is rigidly fixed or rigidly supported to an interior portion or gunwale portion of the hull of the rowing boat 10. The hull of the rowing boat 10 can have any of a variety of conventional shapes and configurations depending upon whether the type of boat. More specifically, the size and shape of the hull of the rowing boat 10 can have any size and shape that can accommodate the rowing boat footrest assembly 12. It should be apparent to those skilled in the rowing boat field from the drawings and the description herein that the stationary footrest mounting structure 14 can be a structure integrally formed with the hull of the rowing boat 10 or rigidly fixed to the hull of the rowing boat 10.

In this illustrated embodiment, the stationary footrest mounting structure 14 includes a pair of side rails 14*a* and a center rail 14*b*. In particular, the side rails 14*a* are fixedly arranged parallel to one another along the sides of the hull of the boat 10, with the center rail 14*b* being arranged parallel to the side rails 14*a* along a center of the floor of the hull of the boat 10. In this illustrated embodiment, the side rails 14*a* are equidistant from the center rail 14*b*.

The sculling seat structure 16 includes a seat 16*a* and a pair of parallel rails 16*b*. One of the rails 16*b* is disposed on each of the lateral sides of the boat 10. The rails 16*b* slidably support the seat 16*a* to slide smoothly in a fore and aft (longitudinal) direction relative to the hull of the rowing boat 10. The seat 16*a* includes bearing portions such as rolling wheels or bushing surfaces that allow the seat 16*a* to slide along rails 16*b*. The sculling seat structure 16 can be a relatively conventional structure, as shown, and thus, the sculling seat structure 16 will not be discussed in detail herein.

Figure 2:
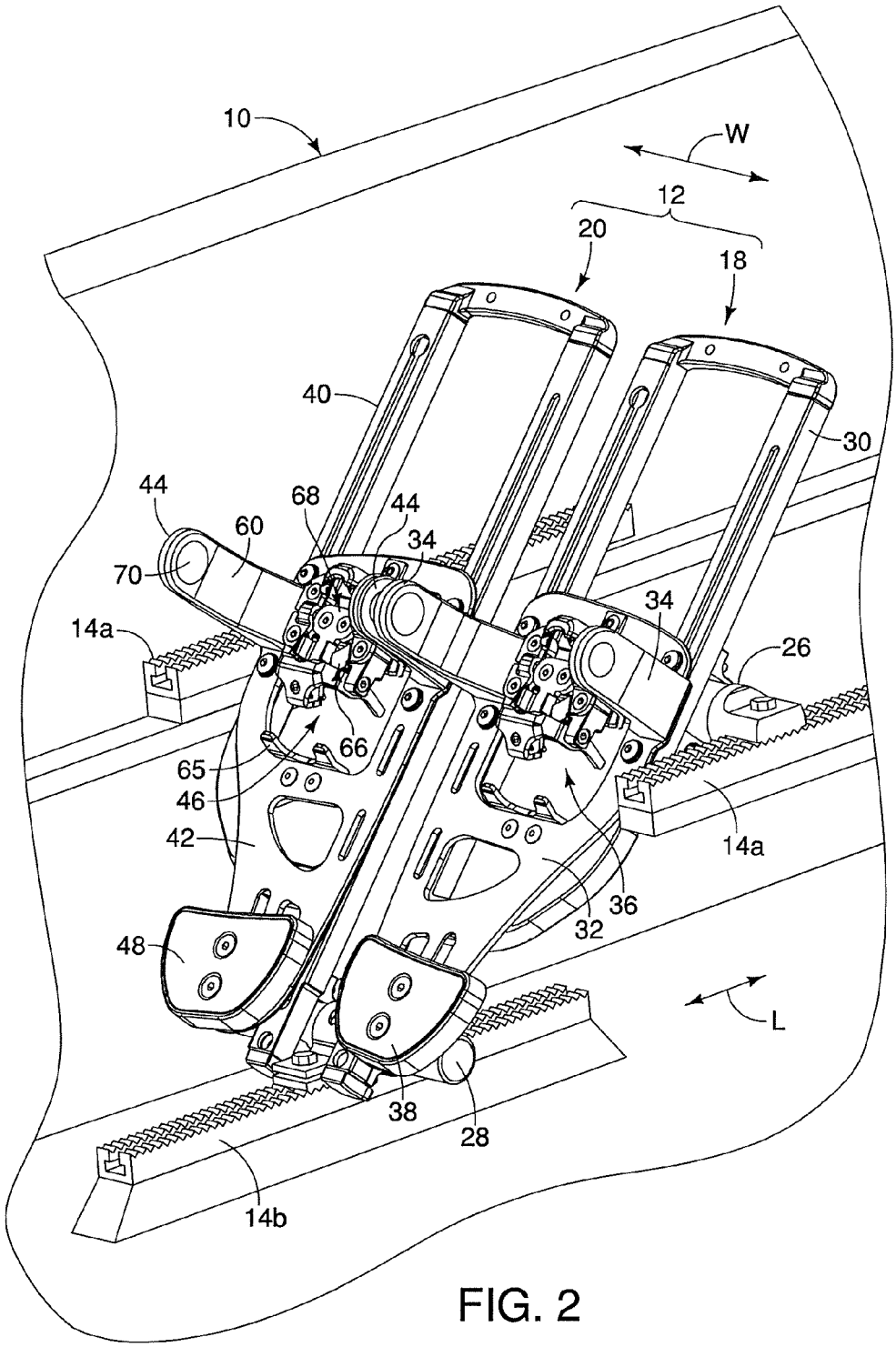
FIG. 2 is a partial perspective view of a portion of the hull of the rowing boat with the rowing boat footrest assembly illustrated in FIG. 1.

As best seen in FIG. 2, the rowing boat footrest assembly 12 includes a first (right) shoe support structure 18 and a second (left) shoe support structure 20. The first and second shoe support structures 18 and 20 collectively constitute a shoe support or a foot stretcher support. As seen in FIG. 2, the first and second shoe support structures 18 and 20 are adjustably coupled to the stationary footrest mounting structure 14 in both lateral and longitudinal directions of the rowing boat 10 as explained below. In this illustrated embodiment, the right and left shoe support structures 18 and 20 are mounted to the side rail 14*a* of the stationary footrest mounting structure 14 by a lateral cross support bar 26 and mounted to the center rail 14*b* by a center support bar 28. In this illustrated embodiment, the lateral cross support bar 26 is adjustably mounted on the side rails 14*a*, while the center support bar 28 is adjustably mounted to the center rail 14*b*. In this way, the lateral cross support bar 26 and the center support bar 28 can be selectively position along the rails 14*a* and 14*b*. Thus, the longitudinal positions of the first and second shoe support structures 18 and 20 can be longitudinally adjusted with respect to the hull of the rowing boat 10.

Figure 3:
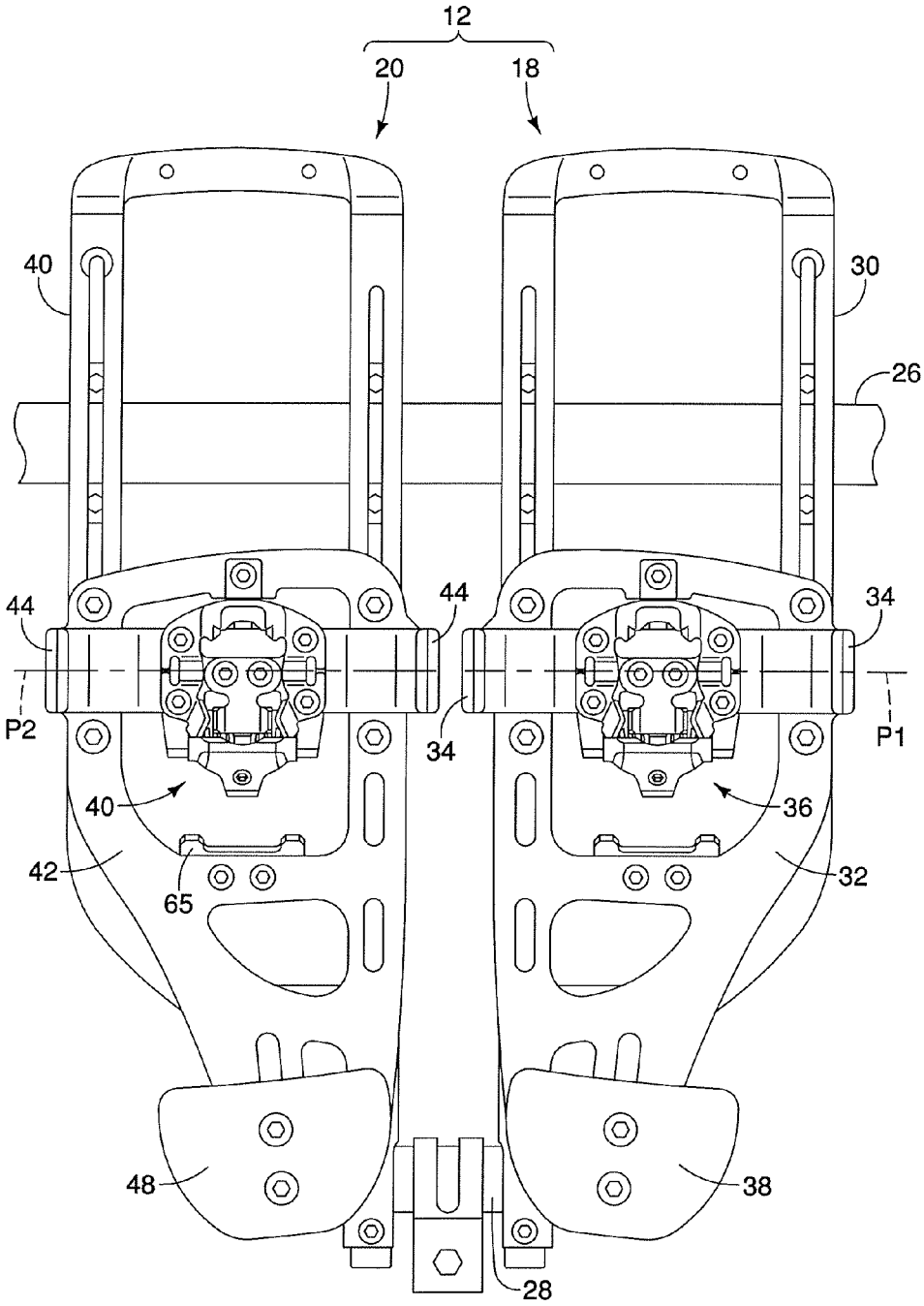
FIG. 3 is a top view of the rowing boat footrest assembly illustrated in FIGS. 1 and 2.

As seen in FIGS. 2 and 3, the right shoe support structure 18 of the rowing boat footrest assembly 12 basically includes a frame part 30, a support plate 32 and a pair of support pillars 34. The frame part 30 is adjustably fixed to the cross support bar 26 and the center support bar 28 by clamps for lateral adjustment with respect to the lateral boat direction W. The support plate 32 is adjustably fixed to the frame part 30. The support pillars 34 are fixed to the upper surface of the support plate 32 for swingably supporting a main footrest member 36 about a pivot axis P1. Also a heal support member 38 is adjustably fixed to the support plate 32.

The frame part 30 and the support plate 32 are rigid members that are constructed of a suitable rigid material. For example, the frame part 30 can be constructed of metal tubing (e.g., aluminum) or non-metallic tubing (e.g., a fiber reinforced polymer), while the support plate 32 can be constructed of a metal plate (e.g., aluminum) or a non-metallic plate (e.g., a fiber reinforced polymer). The support plate 32 is fixed to the upper surface of the frame part 30 as an integrated unit by bolts or other suitable fasteners for adjustment in the longitudinal boat direction L. The heel support member 38 is adjustably mounted on a lower end of the support plate 32 of the base plate 30 by bolts or other suitable fasteners for adjustment in the longitudinal boat direction L.

As seen in FIGS. 2 and 3, the left shoe support structure 20 of the rowing boat footrest assembly 12 basically includes a frame part 40, a support plate 42 and a pair of support pillars 44. The left shoe support structure 20 constitutes an additional shoe support structure with respect to the shoe support structure 18. The frame part 40 is adjustably fixed to the cross support bar 26 and the center support bar 28 by clamps for lateral adjustment with respect to the lateral boat direction W. The support plate 42 is adjustably fixed to the frame part 40 for longitudinal adjustment with respect to the longitudinal boat direction L. The support pillars 44 are fixed to the upper surface of the support plate 42 for swingably supporting a main footrest member 46 about a pivot axis P2. The main footrest member 46 constitutes an additional footrest member with respect to the main footrest member 36. Also a heal support member 48 is adjustably fixed to the support plate 42 for longitudinal adjustment with respect to the longitudinal boat direction L.

With the illustrated arrangement, the right and left shoe support structures 18 and 20 are fixedly mounted to the support bars 26 and 28 in a laterally adjustable manner. In particular, in this illustrated embodiment, the right and left shoe support structures 18 and 20 are independent units which are independently adjustable in the lateral boat direction L of the rowing boat 10 on the support bars 26 and 28. However, it will be apparent to those skilled in the art from this disclosure that this adjustment feature does not need to be included in the rowing boat footrest assembly 12. Once the right and left shoe support structures 18 and 20 are in a fixed position on the support bars 26 and 28, the right and left shoe support structures 18 and 20 are stationary with respect to the hull of the rowing boat 10.

Figure 4:
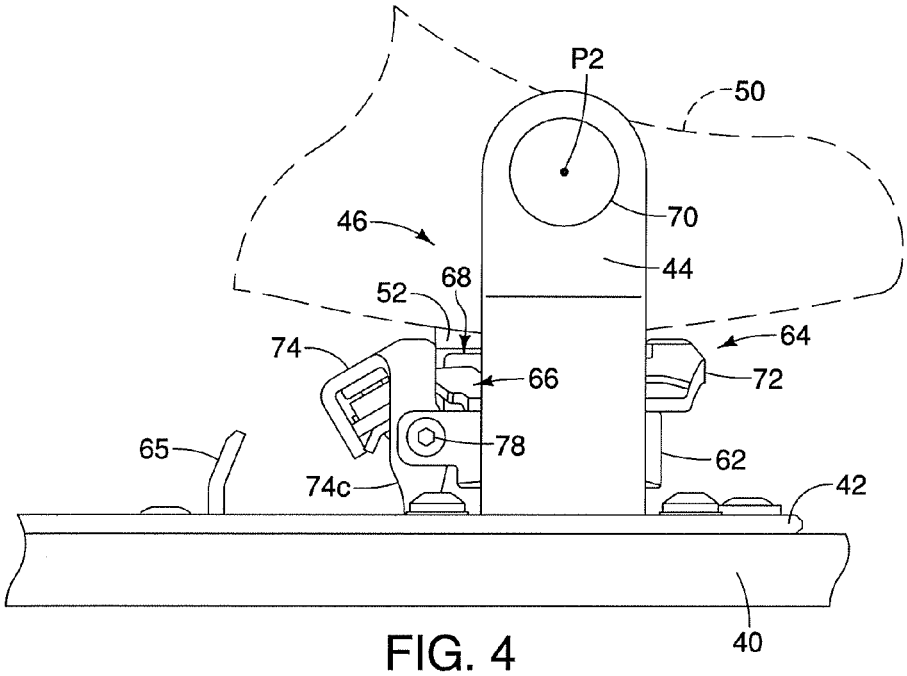
FIG. 4 is a side elevational view of the left footrest of the rowing boat footrest assembly illustrated in FIGS. 1 to 3, with the left footrest in a middle swing position.
Figure 5:
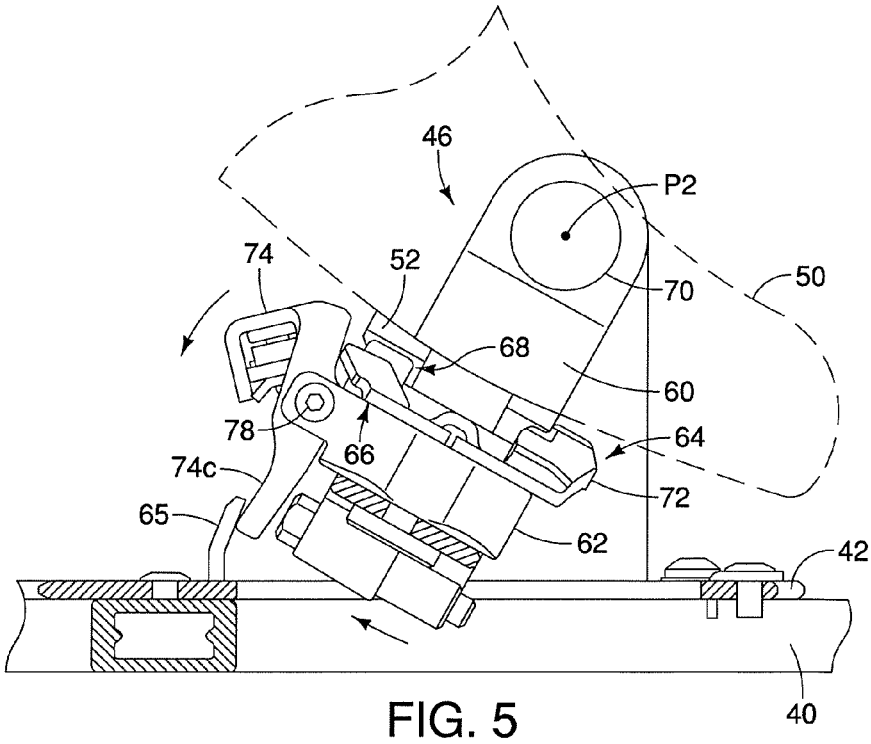
FIG. 5 is a partial cross sectional view of the left footrest of the rowing boat footrest assembly illustrated in FIGS. 1 to 3, with the left footrest pivoted to a releasing position.

In this illustrated embodiment, the main footrest members 36 and 46 are identical. Thus, only the main footrest member 46 will be discussed herein for the sake of brevity. In this illustrated embodiment, as seen in FIGS. 4 and 5, the main footrest member 46 is a cleat type shoe attachment mechanism. In such a clipless type shoe attachment mechanism, a shoe 50 includes an attachment part or cleat 52 that is releasably retained by the main footrest member 46 in a conventional manner.

Figure 6:
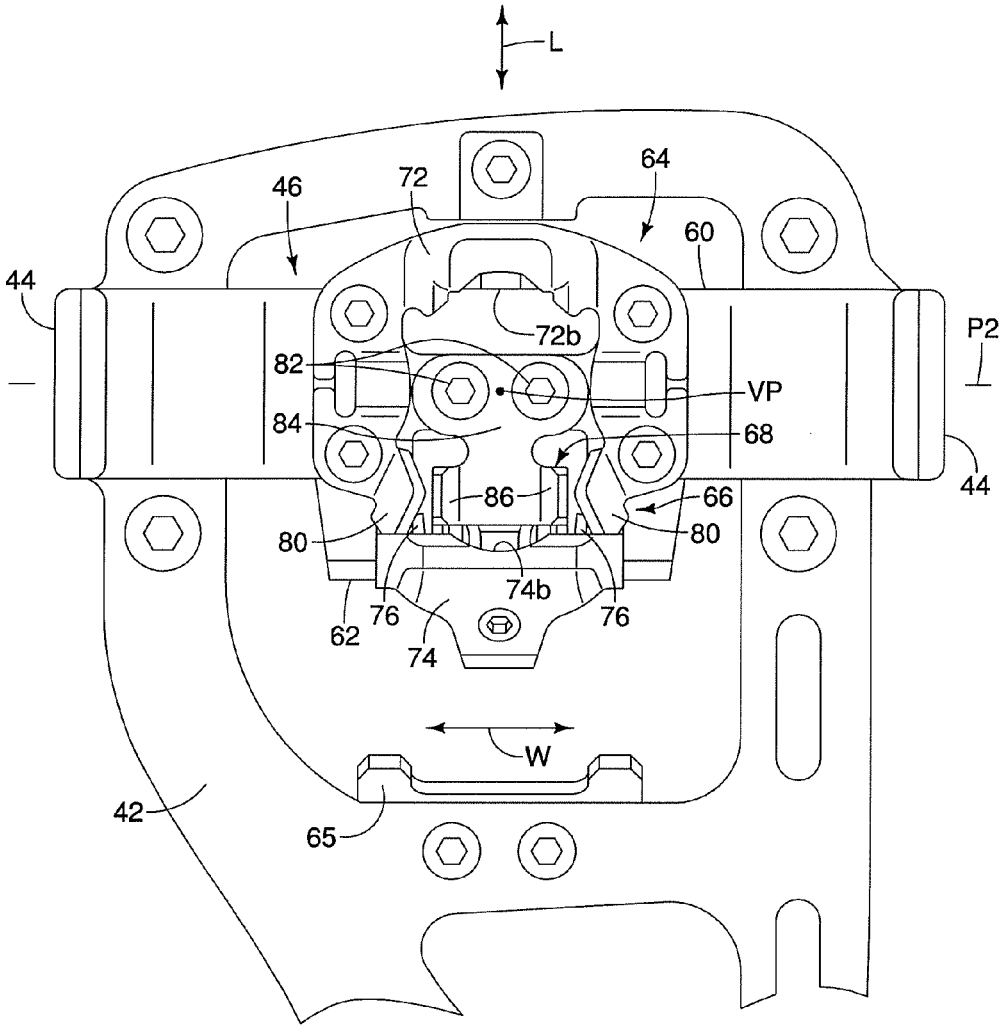
FIG. 6 is a partial top view of the left footrest of the rowing boat footrest assembly illustrated in FIGS. 1 to 3, with the left footrest in the center location.
Figure 7:
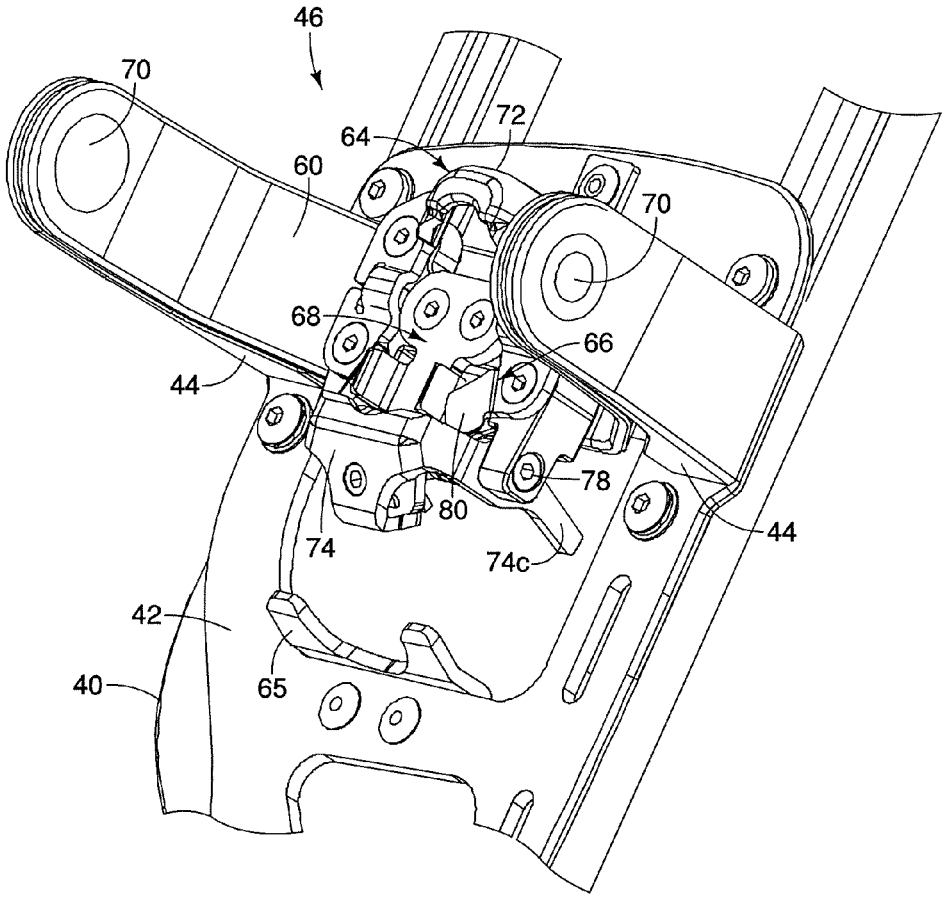
FIG. 7 is a partial top perspective view of the left footrest of the rowing boat footrest assembly illustrated in FIGS. 1 to 3, with the left footrest in the center location, as viewed from the heel end of the cleat binding mechanism.
Figure 8:
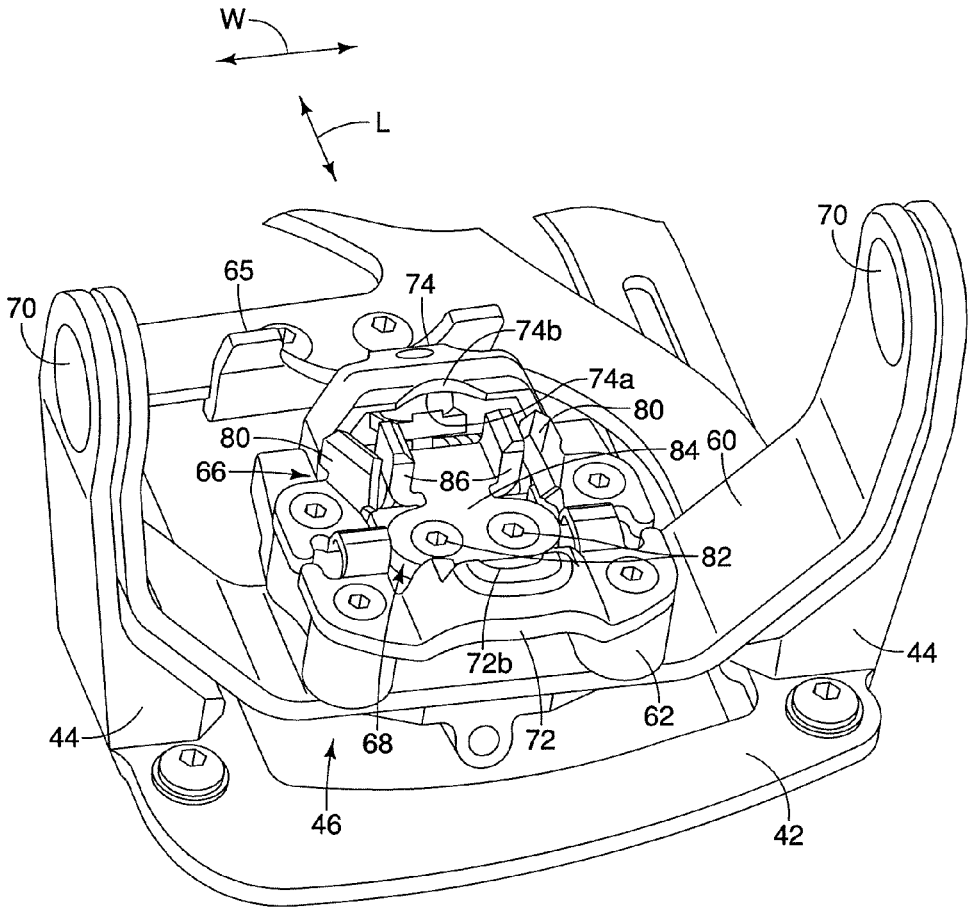
FIG. 8 is a partial top perspective view of the left footrest of the rowing boat footrest assembly illustrated in FIGS. 1 to 3, with the left footrest in the center location, as viewed from the toe end of the cleat binding mechanism.
Figure 9:
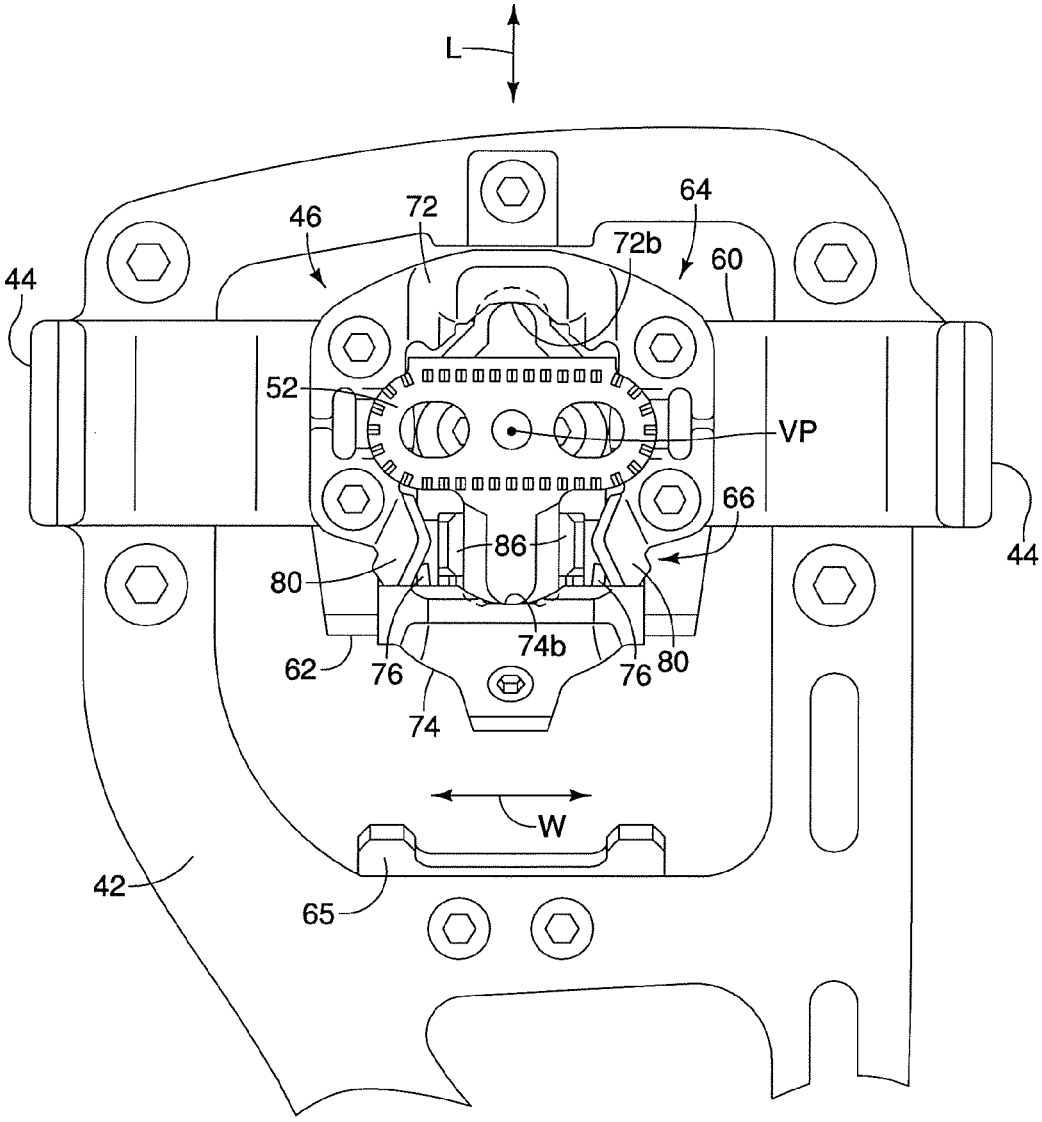
FIG. 9 is a partial top view of the left footrest of the rowing boat footrest assembly illustrated in FIGS. 1 to 3, with the left footrest in the center location as seen in FIG. 6, but with the cleat retained by the cleat binding mechanism.
Figure 10:
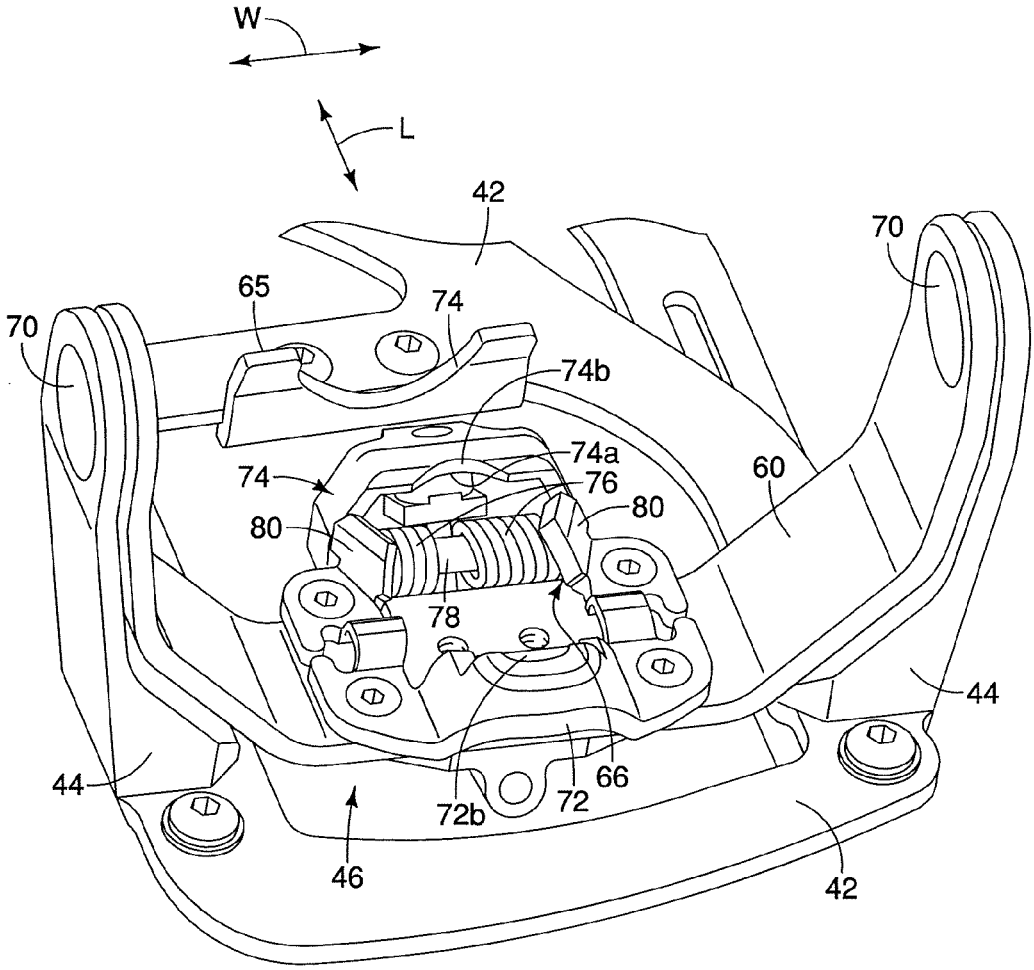
FIG. 10 is a top perspective view, similar to Figure of the left footrest of the rowing boat footrest assembly illustrated in FIGS. 1 to 3, with the left footrest in the center location, as viewed from the toe end of the cleat binding mechanism, but with the detachable cleat limit adapter removed.
Figure 11:
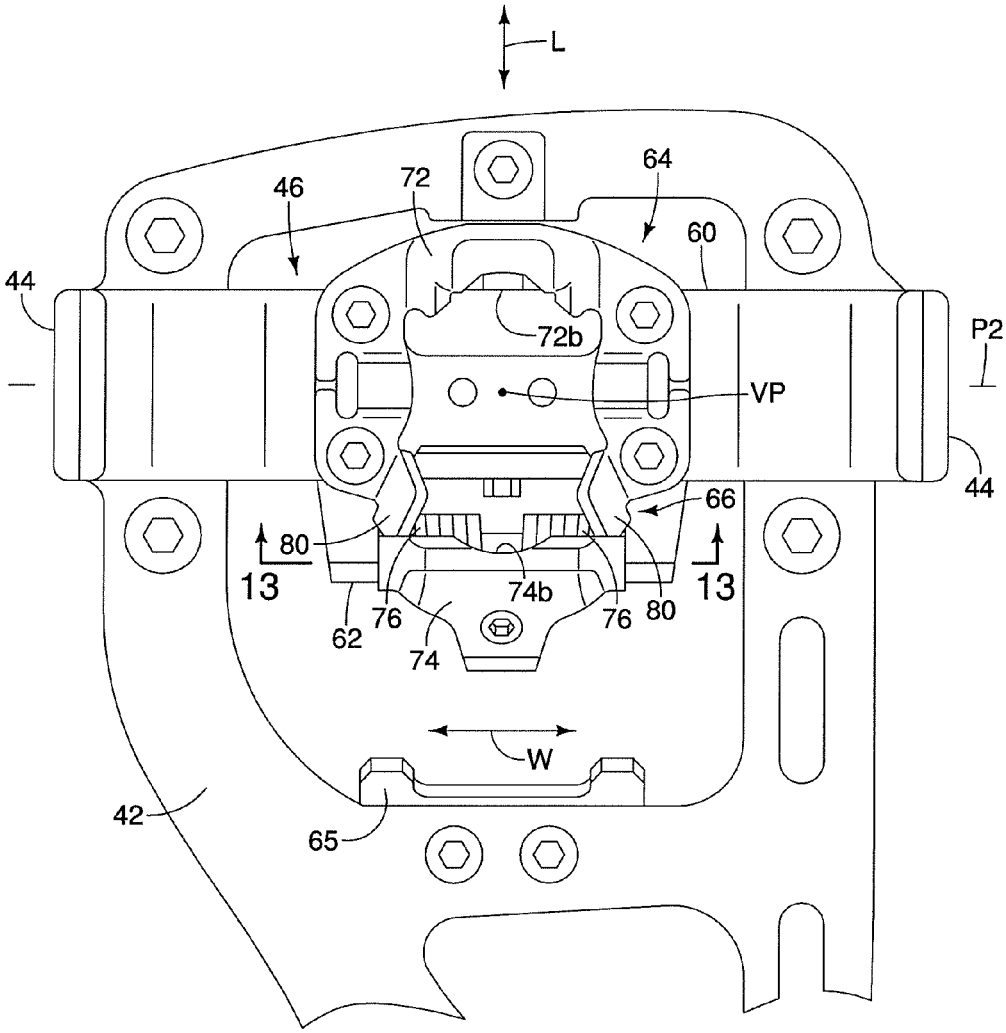
FIG. 11 is a partial top view of the left footrest of the rowing boat footrest assembly illustrated in FIGS. 1 to 3, with the left footrest in the center location as seen in FIG. 6, but with the detachable cleat limit adapter removed.
Figure 12:
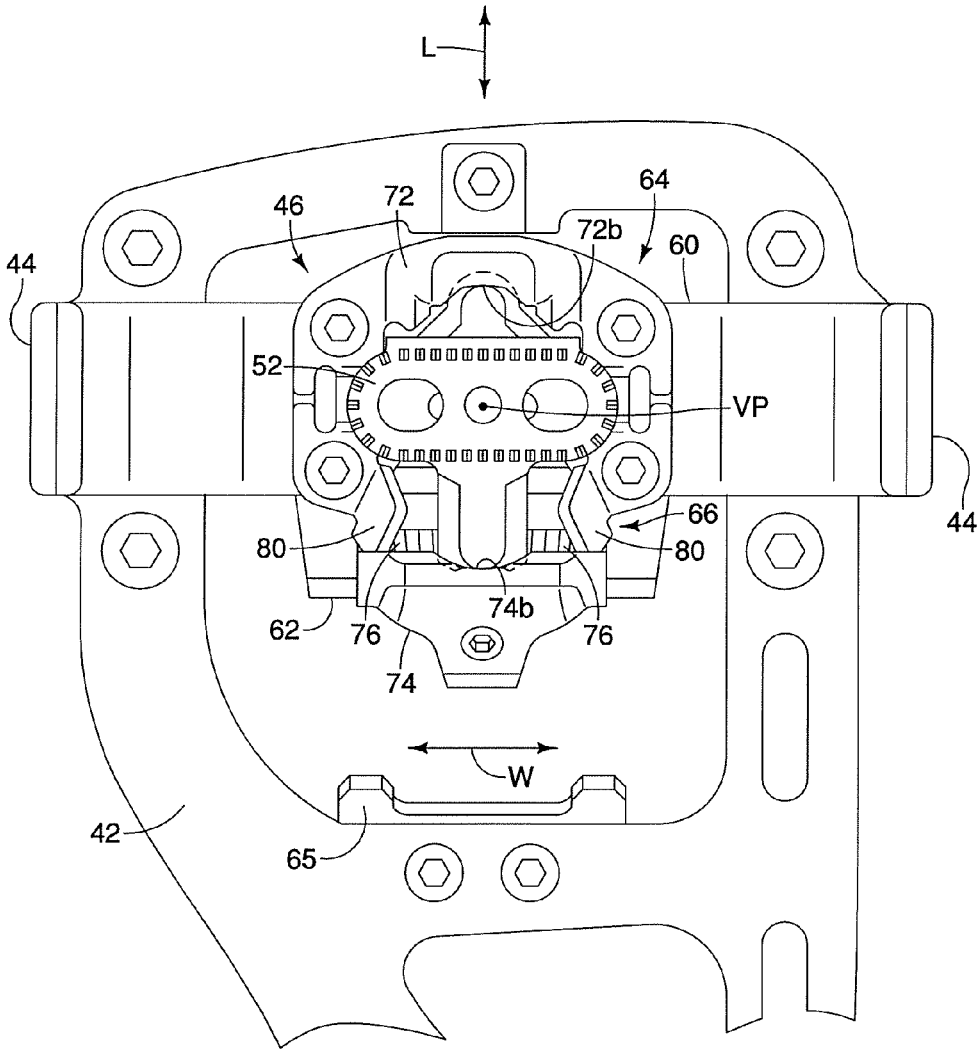
FIG. 12 is a partial top view of the left footrest of the rowing boat footrest assembly illustrated in FIGS. 1 to 3, with the left footrest in the center location as seen in FIG. 11, but with the cleat retained by the cleat binding mechanism.
Figure 13:
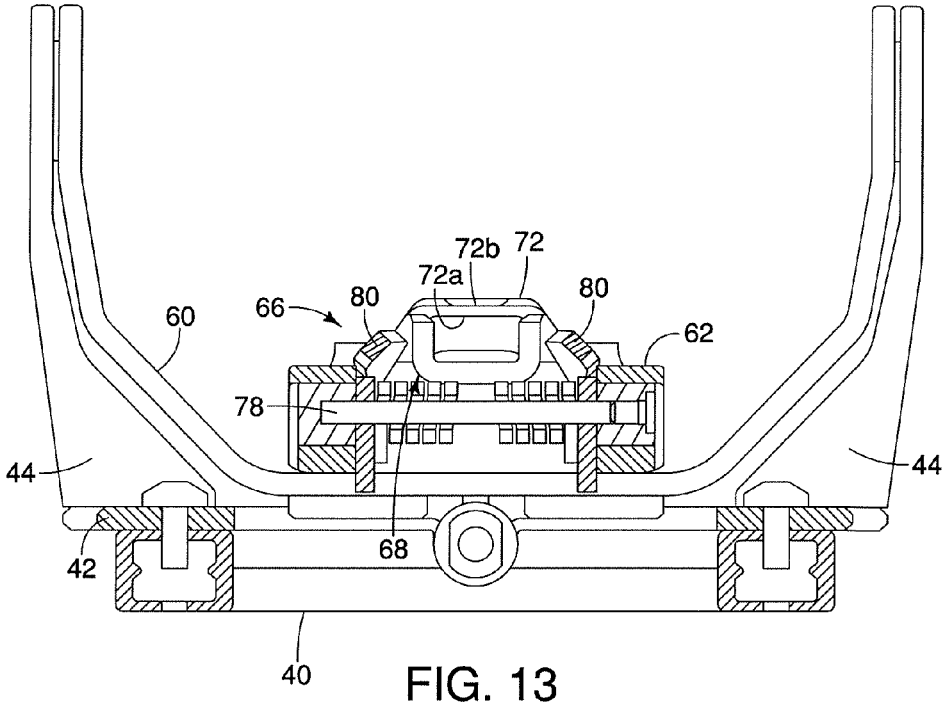
FIG. 13 is a partial cross sectional view of the left footrest of the rowing boat footrest assembly illustrated in FIGS. 1 to 3 as seen along section line 13-13 of FIG. 11, which extends through the first pivot structure of the right footrest.

As seen in FIGS. 6 to 8, basically, the main footrest member 46 includes a swing member 60, a base 62, a cleat attachment structure 64, a cleat limit structure 66 and a cleat adjustment structure 68. The swing member 60 is pivotally attached to the support pillars 44 by a pair of pivot pins 70. The base 62, the cleat attachment structure 64, the cleat limit structure 66 and the cleat adjustment structure 68 are all mounted on the swing member 60 to pivot about the pivot axis P2. In this way, the left shoe support structure 20 pivotally supports the base 62 the cleat limit structure 66 and the cleat adjustment structure 68 about the pivot axis P2, which extend in the widthwise (transverse) direction W relative to a longitudinal axis of the rowing boat footrest assembly 12. Thus, the base 62 and the cleat attachment structure 64 pivots about the pivot axis P2 in a prescribed pivotal rowing range during a rowing with the cleat 52 retained to the cleat attachment structure 64.

As seen in FIG. 5, a release lever plate 65 is mounted on the support plate 42 such that the rower can release the cleat 52 from the cleat attachment structure 64 by swinging the main footrest member 46 outside of the prescribed pivotal rowing range. In particular, when the rower swings the main footrest member 46 outside of the prescribed pivotal rowing range, a portion of the cleat attachment structure 64 contacts the release lever plate 65 to release the cleat 52 from the cleat attachment structure 64 as explained below.

In the illustrated embodiment, the swing member 60 is a rigid U-shaped member. The pivot pins 70 extend through openings in the upper portions of the swing member 60 and the upper portions of the support pillars 34 with the centers of the pivot pins 70 forming the pivot axis P2. The pivot axis P2 of the swing member 60 is located above the cleat attachment structure 64. The base 62 of the main footrest member 46 is fixedly attached to the lower portion of the swing member 60. In this way, the base 62, the cleat attachment structure 64, the cleat limit structure 66 and the cleat adjustment structure 68 are all located below the pivot axis P2 of the swing member 60 as can best be ascertained by FIG. 8.

As seen in FIGS. 5 to 13, the cleat attachment structure 64 basically includes a front cleat retraining portion 72, a rear cleat retraining portion 74 and a pair of biasing elements 76 that form a cleat binding mechanism. The front cleat retraining portion 72 is fixed to the base 62 of the main footrest member 46, while the rear cleat retraining portion 74 is pivotally coupled to the base 62 of the main footrest member 46 by a pivot pin 78. The front cleat retraining portion 72 constitutes an example of a first fixing portion of the cleat attachment structure 64, while the rear cleat retraining portion 74 constitutes an example of a second fixing portion of the cleat attachment structure 64. The biasing elements 76 are torsion springs that are mounted on the pivot pin 78 of the rear cleat retraining portion 74 for urging the rear cleat retraining portion 74 to a cleat engaging position. Thus, the cleat retraining portions 72 and 74 and the biasing elements 76 constitute a step-in attachment structure of the main footrest member 46. A similar clipless type shoe attachment mechanism is disclosed in U.S. patent application Ser. No. 12/361,594, filed on Jan. 29, 2009 and assigned to Shimano Inc. Other examples of clipless type shoe attachment mechanisms are disclosed in U.S. Pat. No. 6,119,551 assigned to Shimano Inc. and U.S. Pat. No. 6,925,908 assigned to Shimano Inc.

The cleat retraining portions 72 and 74 face towards each other to restrain the cleat 52 in the longitudinal boat direction L. The cleat retraining portions 72 and 74 define a cleat receiving area therebetween. The cleat retraining portion 72 has a first cleat restraining surface 72*a* and a first cleat abutment surface 72*b*. The cleat retraining portion 74 has a second cleat restraining surface 74*a* and a second cleat abutment surface 74*b*. The cleat abutment surfaces 72*b* and 74*b* are curved surfaces that are arranged to define a virtual pivot VP of the cleat 52 relative to the cleat attachment structure 64.

When the main footrest member 46 is pivoted or swung about the second pivot axis P2 so that portions 74*c* of the rear cleat retraining portion 74 contact the release lever plate 65, further movement of the main footrest member 46 against the release lever plate 65 cause the rear cleat retraining portion 74 to pivot to a cleat releasing position against the urging forces of the biasing elements 76. In this way, the rower's shoe can be easily released from between the cleat retraining portions 72 and 74.

Figure 16:
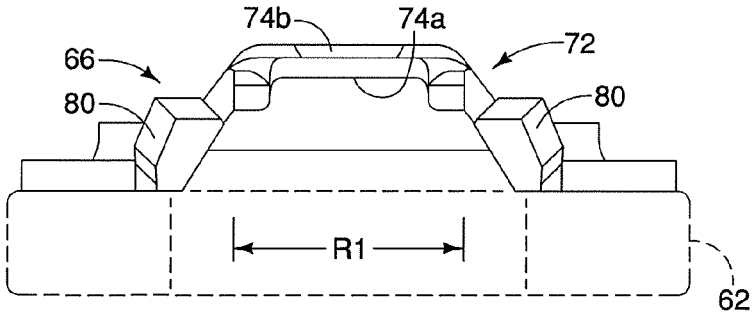
FIG. 16 is an elevational view of the front cleat retaining portion, as viewed from the heel end of the front cleat retaining portion.
Figure 17:
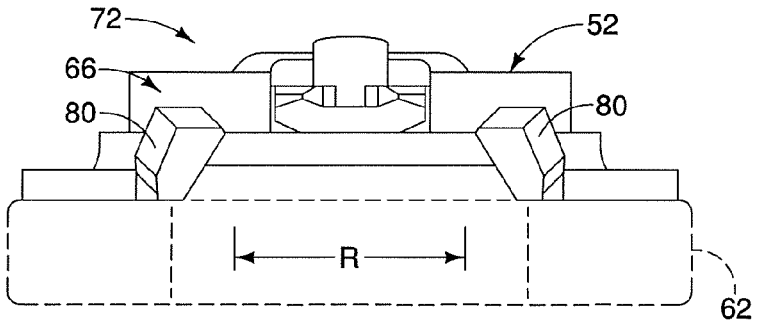
FIG. 17 is an elevational view, similar to FIG. 16, of the front cleat retaining portion, as viewed from the heel end of the front cleat retaining portion, but showing the cleat shown in the installed position.

In this embodiment, the cleat limit structure 66 is integrated with the front cleat retraining portion 72 such that the cleat limit structure 66 and the front cleat retraining portion 72 are a one-piece member. In particular, the cleat limit structure 66 of this embodiment is formed by a pair of flanges or stops 80. The cleat limit structure 66 limits a movement of the cleat 52 to a first movement range R1 in a transverse direction W with respect to the longitudinal boat direction L as best seen in FIG. 16. The first movement range R1 is a maximum cleat movement range.

Figure 14:
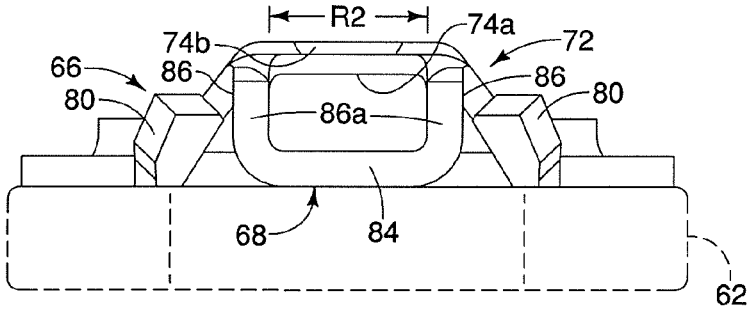
FIG. 14 is an elevational view of the detachable cleat limit adapter and the front cleat retaining portion that includes a cleat limit structure, as viewed from the heel end of the front cleat retaining portion.
Figure 15:
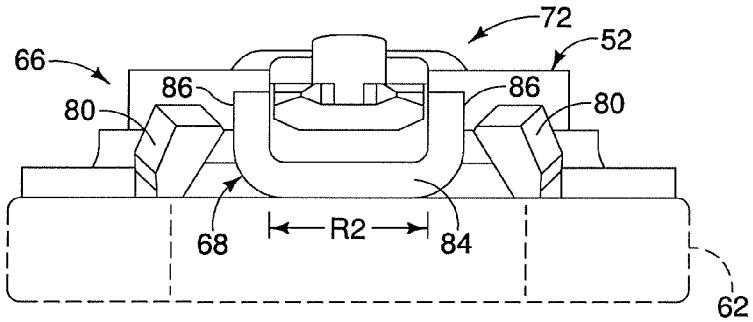
FIG. 15 is an elevational view, similar to FIG. 14, of the detachable cleat limit adapter and the front cleat retaining portion, as viewed from the heel end of the front cleat retaining portion, but with the cleat shown in the installed position.

In this embodiment, the cleat adjustment structure 68 is provided at a location on the base 62 such that the cleat adjustment structure 68 adjusts the first movement range R1 to a second movement range R2 that is smaller than the first movement range R2 as best seen in FIG. 14. The cleat adjustment structure 68 is releasably attached to the base 62 by a pair of fasteners 82. In other words, the cleat adjustment structure 68 constitutes a detachable floating limit adapter that is releasably attached to the base 62 in a location that limits the first movement range R1 to a second movement range R2 that is smaller than the first cleat movement range R1. Here, in this embodiment, no lateral movement of the cleat 52 is permits by the cleat adjustment structure 68. In particular, the cleat adjustment structure 68 has a mounting portion 84 and two upstanding flanges or stops 86 that extend perpendicularly from one end of the mounting portion 84 to define a U-shaped portion. The upstanding flanges or stops 86 form two opposed lateral stop surfaces 86*a* that are located closer to the rear cleat retraining portion 74 than to the front cleat retraining portion 72. The cleat adjustment structure 68 includes at least two separate stops that form a pair of opposed lateral stop surfaces.

As seen in FIGS. 14 to 17, the rower can selectively limit the amount of lateral float of the cleat 52 relative to the base 62 to the second movement range R2 by installing the cleat adjustment structure 68 to the base 62. However, when the cleat adjustment structure 68 is detached from the base 62, the amount of lateral float of the cleat 52 relative to the base 62 is adjusted to the first movement range R1.

Figure 18:
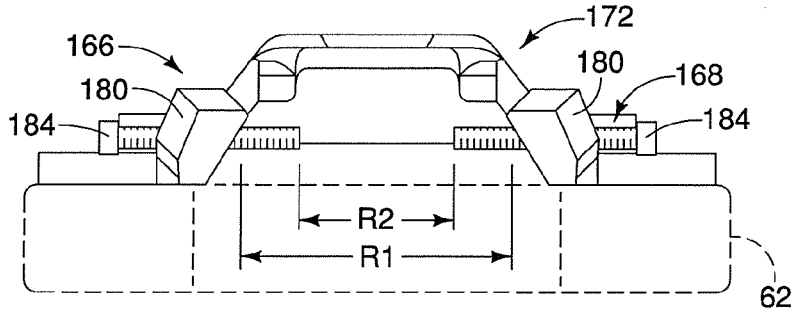
FIG. 18 is an elevational view of an alternative front cleat retaining portion in accordance with an alternative embodiment, as viewed from the heel end of the alternative front cleat retaining portion, with an alternative adjustment structure in a first adjustment position.
Figure 19:
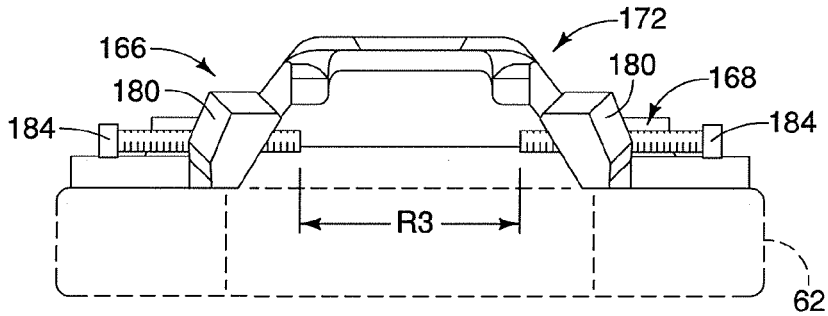
FIG. 19 is an elevational view of the alternative front cleat retaining portion illustrated in FIG. 18, with the alternative adjustment structure in a second adjustment position.

Referring now to FIGS. 18 and 19, an alternative cleat adjustment structure 168, which is provided on an alternative front cleat retraining portion 172 will now be explained. The front cleat retraining portion 172 is identical to the front cleat retraining portion 72, except for the cleat limit structure 66 has been changed. Here, the front cleat retraining portion 172 is attached to the base 62 of the main footrest member 46 by a plurality of fasteners. Thus, the front cleat retraining portion 172 is installed on the left shoe support structure 20 of the rowing boat footrest assembly 12, which is discussed above. In this embodiment, a cleat limit structure 166 is integrated with the front cleat retraining portion 172 such that the cleat limit structure 166 and the front cleat retraining portion 172 are a one-piece member. In particular, the cleat limit structure 166 of this embodiment is formed by a pair of flanges or stops 180. The cleat adjustment structure 168 of this embodiment is formed by a pair of adjustment screws 184 that are threaded into threaded holes of flanges 180. By adjusting the location of the screws 184 (two separate stops) relative to the flanges 180, the first movement range R1 of the flanges 180 can be limited to a smaller movement range such as the movement range R2 or a movement range R3. Thus, the tips of the screws 184 form a pair of opposed lateral stop surfaces.

Figure 20:
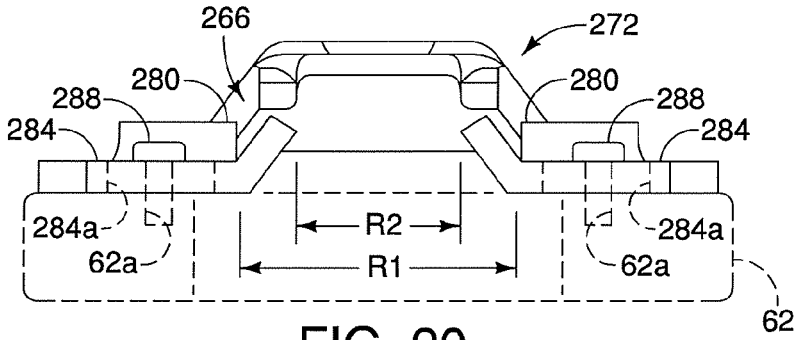
FIG. 20 is an elevational view of another alternative front cleat retaining portion in accordance with another alternative embodiment, as viewed from the heel end of the alternative front cleat retaining portion, with another alternative adjustment structure in a first adjustment position.
Figure 21:
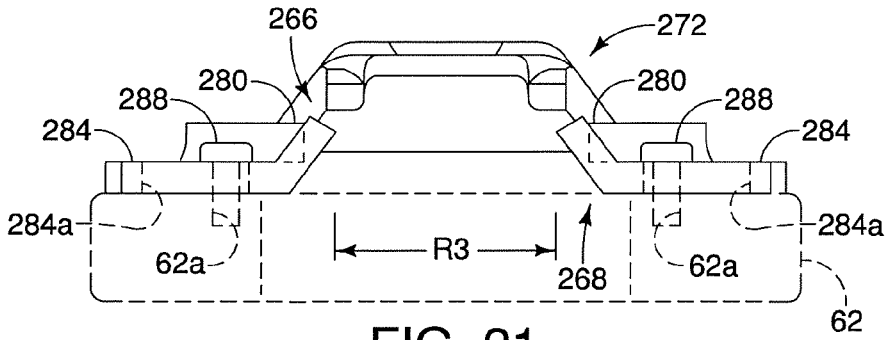
FIG. 21 is an elevational view of the alternative front cleat retaining portion illustrated in FIG. 20, with the alternative adjustment structure in a second adjustment position.

Referring now to FIGS. 20 and 21, an alternative cleat adjustment structure 268, which is provided on an alternative front cleat retraining portion 272 will now be explained. The front cleat retraining portion 272 is identical to the front cleat retraining portion 72, except for the cleat limit structure 66 has been changed. Here, the front cleat retraining portion 272 is attached to the base 62 of the main footrest member 46 by a plurality of fasteners. Thus, the front cleat retraining portion 272 is installed on the left shoe support structure 20 of the rowing boat footrest assembly 12, which is discussed above. In this embodiment, a cleat limit structure 266 is integrated with the front cleat retraining portion 272 such that the cleat limit structure 266 and the front cleat retraining portion 272 are a one-piece member. In particular, the cleat limit structure 266 of this embodiment is formed by a pair of abutments or stops 280. The cleat adjustment structure 268 of this embodiment is formed by two adjustment plates 284. The adjustment plates 284 are attached to the base 62 by screws or fasteners 288 that pass through elongated attachment opening 284*a* and are threaded into threaded holes 62*a* of the base 62. By adjusting the location of the plates 284 (two separate stops) relative to the abutments 280, the first movement range R1 of the abutments 280 can be limited to a smaller movement range such as the movement range R2 or a movement range R3.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiment(s), the following directional terms "forward", "rearward", "above", "downward", "vertical", "horizontal", "below" and "transverse" as well as any other similar directional terms refer to those directions of a boat equipped with the rowing boat footrest assembly. Accordingly, these terms, as utilized to describe the rowing boat footrest assembly should be interpreted relative to a boat equipped with the rowing boat footrest assembly as used in the normal rowing position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a base;

an attachment structure coupled to the base, and configured and arranged to support a cleat;

a limit structure limiting a movement of the cleat to a first movement range in a transverse direction with respect to a longitudinal boat direction;

an adjustment structure provided at a location such that the adjustment structure adjusts the first movement range to a second movement range that is smaller than the first movement range;

an additional attachment structure;

an additional limit structure limiting a movement of an additional cleat to a third movement range in a transverse direction with respect to the longitudinal boat direction; and an additional adjustment structure provided at a location such that the additional adjustment structure adjusts the third movement range to a fourth movement range that is smaller than the third movement range.

2. The rowing boat footrest assembly according to claim 1, wherein the attachment structure includes a cleat binding mechanism having a first portion and a second portion, the first and second portions face towards each other to restrain the cleat in the longitudinal boat direction.

3. The rowing boat footrest assembly according to claim 2, wherein the first portion has a first surface and the second portion has a second surface, and at least one of the first and second surfaces being curved and arranged such that the first and second surfaces defines a virtual pivot of the cleat relative to the attachment structure.

4. The rowing boat footrest assembly according to claim 2, wherein at least one of the first and second portions is movable with respect to the base.

5. The rowing boat footrest assembly according to claim 4, wherein the first portion is non-movable with respect to the base.

6. The rowing boat footrest assembly according to claim 2, wherein the adjustment structure has two opposed lateral stop surfaces that are located closer to one of the first and second portions than to other of the first and second portions.

7. The rowing boat footrest assembly according to claim 1, wherein the adjustment structure is releasably attached in the location.

8. The rowing boat footrest assembly according to claim 7, wherein the adjustment structure includes an U-shaped portion with a pair of opposed lateral stop surfaces.

9. The rowing boat footrest assembly according to claim 7, wherein the adjustment structure includes at least two separate stops that form a pair of opposed lateral stop surfaces.

10. The rowing boat footrest assembly according to claim 9, wherein the at least two separate stops includes at least two adjustment screws.

11. The rowing boat footrest assembly according to claim 9, wherein the at least two separate stops includes at least two adjustment plates, each of the adjustment plates includes an elongated attachment opening that receives a fastener.

12. The rowing boat footrest assembly according to claim 1, further comprising a support structure pivotally supporting the base and the attachment structure about a pivot axis extending in a transverse direction to a longitudinal axis of the rowing boat footrest assembly so that the base and the attachment structure pivots about the pivot axis in a prescribed pivotal rowing range during a rowing with the cleat retained to the attachment structure.

13. A rowing boat footrest assembly comprising:

a base;

an attachment structure coupled to the base, and configured and arranged to support a cleat, the attachment structure including a cleat binding mechanism having a first portion and a second portion, the first and second portions facing towards each other to restrain the cleat in the longitudinal boat direction;

a limit structure limiting a movement of the cleat to a first movement range in a transverse direction with respect to a longitudinal boat direction; and an adjustment structure provided at a location such that the adjustment structure adjusts the first movement range to a second movement range that is smaller than the first movement range without changing a relative position of the attachment structure with respect to the base, the adjustment structure including a detachable U-shaped member having a first lateral stop located on a first lateral side of a cleat receiving area defined by the first and second portions and a second lateral stop located on a second lateral side of the cleat receiving area, the first and second lateral sides being different.

14. A rowing boat footrest assembly comprising:

a base;

an attachment structure coupled to the base, and configured and arranged to support a cleat, the attachment structure including cleat binding mechanism having a first portion and a second portion, the first and second portions facing towards each other to restrain the cleat in the longitudinal boat direction;

a limit structure limiting a movement of the cleat to a first movement range in a transverse direction with respect to a longitudinal boat direction; and an adjustment structure provided at a location such that the adjustment structure adjusts the first movement range to a second movement range that is smaller than the first movement range without changing a relative position of the attachment structure with respect to the base, the adjustment structure including a first adjustment screw threaded into one of the first and second portions and a second adjustment screw threaded into the one of the first and second portions, the first and second adjustment screws being located on opposite lateral sides of a cleat receiving area defined between the first and second portions to adjustably restrict movement of the cleat in the transverse direction by contacting the cleat directly.

15. A rowing boat footrest assembly comprising:

a base;

an attachment structure coupled to the base, and configured and arranged to support a cleat, the attachment structure including cleat binding mechanism having a first portion and a second portion, the first and second portions facing towards each other to restrain the cleat in the longitudinal boat direction;

a limit structure limiting a movement of the cleat to a first movement range in a transverse direction with respect to a longitudinal boat direction, the limit structure including a first lateral stop located on a first lateral side of a cleat receiving area defined by the first and second portions and a second lateral stop located on a second lateral side of the cleat receiving area, the first and second lateral sides being different; and an adjustment structure provided at a location such that the adjustment structure adjusts the first movement range to a second movement range that is smaller than the first movement range without changing a relative position of the attachment structure with respect to the base, the adjustment structure including a first adjustment plate located on the first lateral side and a second adjustment plate located on the second lateral side, each of the adjustment plates having an elongated attachment opening that receives a fastener for adjustably fixing the first and second adjustment plates, respectively.

16. A rowing boat footrest assembly comprising:

a base;

a step-in attachment structure coupled to the base to releasably support a cleat to the base, the step-in attachment structure including a cleat binding mechanism having a first cleat retaining portion with a first surface and a second cleat retaining portion with a second surface, the first and second cleat retaining portions face towards each other to restrain the cleat in a longitudinal boat direction and at least one of the first and second surfaces being curved and arranged such that the first and second surfaces defines a virtual pivot of the cleat relative to the step-in attachment structure;

a limit structure limiting a movement of the cleat retained in the step-in attachment structure to a first movement range in a transverse direction with respect to a longitudinal boat direction with the cleat remaining fully engaged with the step-in attachment structure; and an adjustment structure provided at a location with respect to the step-in adjustment structure such that the step-in adjustment structure adjusts the first movement range to a second movement range that is smaller than the first movement range.

17. The rowing boat footrest assembly according to claim 16, wherein the adjustment structure includes a detachable U-shaped member having a first lateral stop located on a first lateral side of a cleat receiving area defined by the first and second cleat retaining portions and a second lateral stop located on a second lateral side of the cleat receiving area, the first and second lateral sides being different.

18. The rowing boat footrest assembly according to claim 16, wherein the adjustment structure includes a first adjustment screw threaded into one of the first and second cleat retaining portions and a second adjustment screw threaded into the one of the first and second cleat retaining portions, the first and second adjustment screws being located on opposite lateral sides of a cleat receiving area defined between the first and second cleat retaining portions to adjustably restrict movement of the cleat in the transverse direction by contacting the cleat directly.

19. The rowing boat footrest assembly according to claim 17, wherein the limit structure includes a first lateral stop located on a first lateral side of a cleat receiving area defined by the first and second cleat retaining portions and a second lateral stop located on a second lateral side of the cleat receiving area, the first and second lateral sides being different; and the adjustment structure includes a first adjustment plate located on the first lateral side and a second adjustment plate located on the second lateral side, each of the adjustment plates having an elongated attachment opening that receives a fastener for adjustably fixing the first and second adjustment plates, respectively.

* * * * *